US009624447B2

(12) United States Patent
Doering

(10) Patent No.: US 9,624,447 B2
(45) Date of Patent: Apr. 18, 2017

(54) METHOD AND APPARATUS FOR CONVERTING AN ALCOHOL INTO A MOTOR FUEL MIXTURE

(71) Applicant: MAN Truck & Bus AG, Munich (DE)

(72) Inventor: Andreas Doering, Munich (DE)

(73) Assignee: MAN TRUCK & BUS AG, Munich (DE)

( * ) Notice: Subject to any disclaimer, the term of this patent is extended or adjusted under 35 U.S.C. 154(b) by 0 days.

(21) Appl. No.: 13/948,599

(22) Filed: Jul. 23, 2013

(65) Prior Publication Data

US 2014/0026470 A1 Jan. 30, 2014

(30) Foreign Application Priority Data

Jul. 26, 2012 (DE) ..... 10 2012 014 755

(51) Int. Cl.
*C10L 1/02* (2006.01)

(52) U.S. Cl.
CPC ..... *C10L 1/02* (2013.01); *C10L 1/026* (2013.01); *C10L 2270/026* (2013.01); *C10L 2290/562* (2013.01); *C10L 2290/567* (2013.01); *C10L 2290/58* (2013.01); *C10L 2300/30* (2013.01)

(58) Field of Classification Search
CPC ..... F02M 27/02; F02M 25/0228; F02M 25/0742; C10L 1/026; F02B 51/02; F02D 19/0671; F02D 19/0655; F02D 19/084; F02D 19/081
USPC ..... 123/1 A, DIG. 12; 422/198, 109; 44/446, 447, 448, 453
See application file for complete search history.

(56) References Cited

U.S. PATENT DOCUMENTS 4,422,412 A 12/1983 Norton
4,519,342 A * 5/1985 Yoon ..... B01J 8/02 123/1 A
4,716,859 A * 1/1988 Konig ..... B01J 23/40 123/3
4,876,989 A * 10/1989 Karpuk ..... F02B 1/02 123/179.8
5,097,803 A * 3/1992 Galvin ..... F02D 19/0647 123/1 A
5,504,259 A * 4/1996 Diebold ..... C10B 49/12 568/697
7,290,505 B2 * 11/2007 Kamio ..... F02D 19/0628 123/1 A
7,487,631 B2 * 2/2009 Cueman ..... F01N 3/106 123/1 A
7,487,762 B2 * 2/2009 Kaneko ..... F02M 25/00 123/508

(Continued)

FOREIGN PATENT DOCUMENTS

WO 01/02515 A1 1/2001

*Primary Examiner* — Long T Tran
(74) *Attorney, Agent, or Firm* — Lucas & Mercanti, LLP

(57) ABSTRACT

A method and apparatus for converting an alcohol into a fuel mixture which consists of alcohol, ether and water and is suitable for operating a combustion engine, in particular an internal combustion engine in a motor vehicle, converts the alcohol into the fuel mixture in a reactor at a suitable reaction temperature. The mixing ratio of alcohol fraction, ether fraction and water fraction in the fuel mixture is adjusted by controlling at least one reaction parameter of a reaction taking place in the reactor.

13 Claims, 1 Drawing Sheet

(56) References Cited

U.S. PATENT DOCUMENTS

| | | | | |
|---|---|---|---|---|
| 7,523,739 | B2 * | 4/2009 | Kaneko | F02M 25/00 123/381 |
| 7,630,822 | B2 * | 12/2009 | Kaneko | F02M 25/00 123/531 |
| 7,767,156 | B2 * | 8/2010 | Ashe | F28F 27/02 374/147 |
| 7,770,545 | B2 * | 8/2010 | Morgenstern | C01B 3/323 123/1 A |
| 7,933,713 | B2 * | 4/2011 | Leone | F02D 19/081 123/406.16 |
| 7,956,950 | B2 * | 6/2011 | Lee | G02F 1/133345 349/138 |
| 8,245,690 | B2 * | 8/2012 | Stein | F02B 47/04 123/1 A |
| 8,955,468 | B2 * | 2/2015 | Duwig | C10L 1/026 123/1 A |
| 9,109,498 | B2 * | 8/2015 | Bradley | F02B 1/12 |
| 9,109,506 | B2 * | 8/2015 | Mikkelsen | C10L 1/026 |
| 9,140,180 | B2 * | 9/2015 | Gruber | |
| 9,228,543 | B2 * | 1/2016 | De Landa Magarin | F02M 31/10 |
| 9,261,053 | B2 * | 2/2016 | Jacob | F01N 5/02 |
| 2003/0121481 | A1 * | 7/2003 | Dodd | C01B 3/323 123/3 |
| 2006/0180099 | A1 | 8/2006 | Aimoto | |
| 2008/0127933 | A1 * | 6/2008 | Blumberg | F02B 11/00 123/304 |
| 2010/0319635 | A1 * | 12/2010 | Morgenstern | C01B 3/323 123/3 |
| 2011/0247573 | A1 * | 10/2011 | McCann | F02B 9/02 123/3 |

* cited by examiner

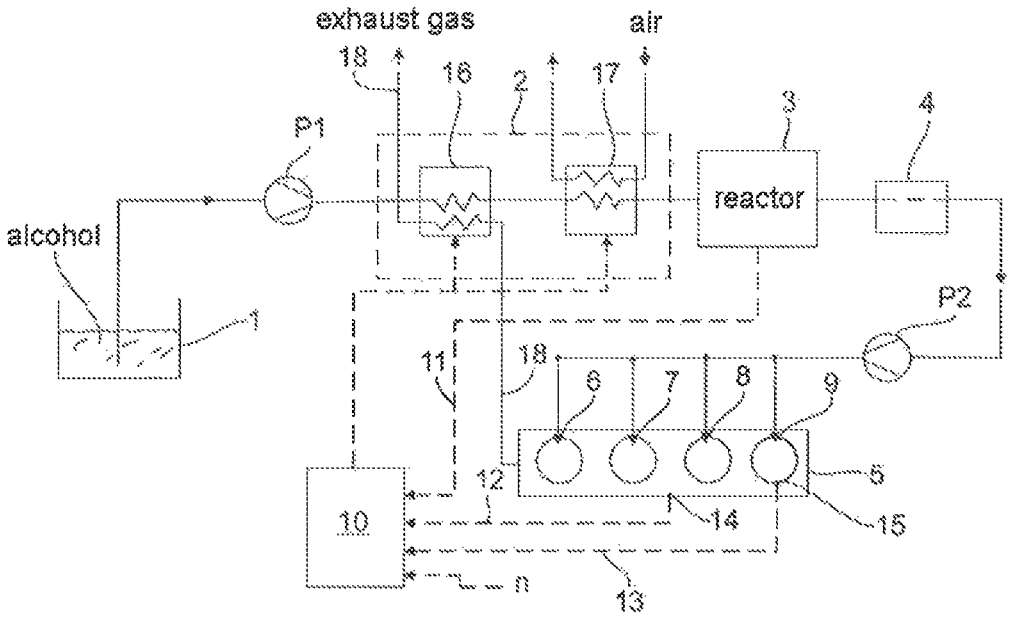
exhaust gas
air
18
16
2
17
3
4
P1
reactor
alcohol
1
P2
11
18
6
7
8
9
5
12
10
14
15
n
13

METHOD AND APPARATUS FOR CONVERTING AN ALCOHOL INTO A MOTOR FUEL MIXTURE

CROSS-REFERENCE TO RELATED APPLICATIONS

This application claims the priority of DE 10 2012 014 755.4 filed Jul. 26, 2012, which is incorporated by reference herein.

BACKGROUND OF THE INVENTION

The invention relates to a method for converting an alcohol into a motor fuel mixture and also to an apparatus for practicing the method.

Replacing conventional fossil motor fuels by alternative motor fuels is gaining more and more attention. Notably alcohols, such as methanol or ethanol, are attractive in this connection, since they are obtainable from regenerative sources in a relatively simple way. However, owing to their low cetane number, these motor fuels cannot be used in auto-ignition, diesel engines. To facilitate combustion in diesel engines, these motor fuels can be additized with additives, such as dimethyl ether or diethyl ether, for raising the cetane number.

A mixture of alcohol, ether and water can also be produced directly during the operation of a combustion engine, in an upstream process, from an alcohol, for example from methanol or ethanol, by using a suitable catalyst.

U.S. Pat. No. 4,422,412 A discloses a method for converting an alcohol into a motor fuel mixture wherein the alcohol (methanol for example) which has been heated to a suitable reaction temperature is converted by means of a catalyst in a reactor into a motor fuel mixture in accordance with the accompanying reaction equation:

$$2CH_3OH \leftrightarrows CH_3—O—CH_3 + H_2O \qquad \text{reaction 1}$$

The methanol ($CH_3OH$) used here is thus converted in the reactor to form additionally dimethyl ether ($CH_3—O—CH_3$) and water ($H_2O$). When ethanol is used for the conversion method to produce the motor fuel mixture, a mixture of ethanol, diethyl ether and water can be produced using the reactor. Gamma-Aluminumoxide can be used as catalyst in the reactor.

The motor fuel mixture obtained according to this known method tends to vary greatly in quality, as evidenced by a greatly varying water content, and therefore in practice it cannot be used to run diesel engines. The variations in quality which occur lead to greatly varying cetane numbers and consequently to greatly varying igniting timing. Moreover, the motor fuel mixture obtained is not always equally suitable for all engine operating points.

SUMMARY OF THE INVENTION

The problem addressed by the invention is that of providing a method for converting an alcohol into a combustion engine fuel mixture of very consistent quality.

According to an embodiment of the present invention, the mixing ratio of alcohol fraction, ether fraction and water fraction in the motor fuel mixture is adjusted by controlling at least one reaction parameter. The mixing ratio of the motor fuel mixture resulting from the conversion of the alcohol depends inter alia on the reaction temperature, so the mixing ratio can be adjusted via an appropriate adjustment of the reaction temperature. The table below exemplifies the dependence of the mixing ratio on the reaction temperature at a reactor pressure of 2 MPa when methanol is used as the alcohol which is converted into a motor fuel mixture of alcohol, ether and water in a reactor:

| Reaction temperature [° C.] | Alcohol fraction [%] | Ether fraction [%] | Water fraction [%] |
|---|---|---|---|
| 200 | 8 | 67 | 25 |
| 300 | 14 | 62 | 24 |
| 400 | 19 | 59 | 22 |
| 500 | 22 | 57 | 21 |

Adjustment to a desired reaction temperature is possible by appropriately controlling the temperature of the supplied alcohol, for example methanol. Reaction pressure is a further reaction parameter which can be used to adjust the mixing ratio of the motor fuel mixture obtained according to the invention.

Investigations have shown that the formation of dimethyl ether (DME) as per reaction 1 proceeds in accordance with the following reaction rate model:

$$-\frac{dc_{DME}}{dt} = \frac{K_r K_M^2 P_M^2}{(1 + K_M P_M)^2}$$

where $$-\frac{dc_{DME}}{dt}$$

is the amount of substance change rate of DME $K_M$ is the equilibrium constant of methanol $P_M$ is the methanol partial pressure $k_r$ is the rate constant of the reaction $$k_r = k_0 e^{-\frac{E_A}{RT}} \text{ (Arrhenius approach)}$$

$$E_A \text{ is the activation energy } \left(ca.\ \frac{60\ \text{kJ}}{\text{mol}}\right)$$

It is clear from this that the rate of DME formation depends not only on the methanol partial pressure but also—via the temperature dependence of the rate constant $k_r$—on the reaction temperature.

By adjusting the mixing ratio of alcohol fraction, ether fraction and water fraction in the motor fuel mixture, comparatively simple open and closed loop control systems can deliver a desired cetane number. A cetane number of below 50 and/or an octane number of above 95 RON can be achieved to be able to operate a combustion engine in the operating region of homogeneous compression ignition, while a diesel engine fuel mixture having a cetane number of more than 50 can be produced through appropriate control of the reaction taking place in the reactor.

At least one reaction parameter can more particularly also be controlled according to operating parameters of the combustion engine for which the fuel mixture is intended. Hence the fuel mixture can be adapted in its properties, for example to operating parameters, such as charge pressure, speed and/or load, in order that optimized operation of the combustion engine may be achieved.

Reaction parameters can also be controlled according to operating parameters of an exhaust-gas aftertreatment system, for example in order to achieve a very clean burn in the combustion engine.

Reaction parameters can also be controlled according to the constitution of the alcohol used, in which case the purity of the alcohol used can also be taken into account as a reaction parameter.

Methanol or ethanol can be used for example to convert an alcohol into a motor fuel mixture, although to achieve desired motor fuel properties a methanol-ethanol mixture can also be used as the alcohol to be converted.

The motor fuel mixture obtained using the method of the present invention may accordingly contain dimethyl ether and/or diethyl ether as ether fraction.

Another problem addressed by the invention is that of providing an apparatus for converting an alcohol into a combustion engine fuel mixture which can be varied with regard to its component fractions.

In an apparatus according to an embodiment of the invention, the alcohol supplied to the reactor is heated by means of a heating device. A control device adjusts the heating of the alcohol in the heating device according to reaction parameters of a conversion process taking place in the reactor and/or according to operating parameters of a related combustion machine. Appropriate heating of the supplied alcohol results in different reaction temperatures which can be varied between 200 and 500° C. for example. Depending on the setting for the reaction temperature, the reaction product obtained will be a motor fuel mixture having a desired alcohol/ether/water mixing ratio. The mixing ratio is determinative of the combustion properties of the fuel mixture in the combustion engine. These combustion properties can be adjusted in a simple manner by controlling the reaction temperature in a closed loop control system.

A preferred embodiment of the apparatus according to the invention comprises a heating device which consists of an exhaust-gas heat exchanger and an air heat exchanger. At least one of the two heat exchangers is controlled with regard to the heat transfer to the alcohol flowing therethrough and supplied to the reactor. The air heat exchanger therein preferably serves as a cooling device for cooling the alcohol heated in the upstream exhaust-gas heat exchanger down to a desired processing temperature. Only controlling the cooling by the air heat exchanger can suffice here to obtain a desired reaction temperature in the reactor.

Sensors measuring the temperature and/or pressure in the reactor can be used in a control device as part of a closed loop control system to control the heating of the supplied alcohol. A temperature closed bop control system of this type is realizable with comparatively simple means.

In addition, the pressure in the reactor can &so be controlled/modulated independently of the temperature, for example by means of a pressure control valve and/or by varying the amount supplied and/or removed.

The reaction process taking place in the reactor can also be effected according to the cylinder pressure and/or knocking sensor signals. Cylinder pressure sensors and/or knocking sensors can be mounted on the combustion engine for this purpose, and transmit their measurement signals, via measurement lines, to the control device for adjusting the heating of the alcohol and/or the pressure in the reactor.

The control device for controlling the heating of the alcohol supplied to the reactor can also take account of further operating parameters of the combustion engine and its exhaust-gas aftertreatment system in order that fuel combustion may be optimized. More particularly, a reduced level of pollutants and also improved fuel economy can be achieved as a result.

BRIEF DESCRIPTION OF THE DRAWING

FIG. 1 shows a schematic depiction of an apparatus for converting an alcohol into a combustion engine fuel mixture according to an embodiment of the present invention.

DETAILED DESCRIPTION OF THE PREFERRED EMBODIMENT

The apparatus has a tank 1 which contains an alcohol (methanol or ethanol for example) which is fed by a first pump P1 through a heating device 2 to a reactor 3. In reactor 3, the alcohol is converted at a suitable reaction temperature into a motor fuel mixture which is fed via a chamber 4 and a second pump P2 to a combustion engine 5. The combustion engine 5 is for this equipped with injection nozzles 6 to 9, via which the motor fuel mixture is injected into the combustion chambers of combustion engine 5.

The apparatus depicted in FIG. 1 can more particularly be disposed in a motor vehicle with a diesel engine as combustion engine 5.

In order that the motor fuel mixture supplied to combustion engine 5 has a mixing ratio of its alcohol, ether and water fractions which is suitable for combustion engine 5, heating device 2 heats the alcohol before entry into reactor 3 to a suitable temperature therefor. The process of heating is controlled by a control device 10 according to two or more operating parameters. Measurement signals representing different operating parameters are sent for this via measurement signal lines 11 to 13 to the control device 10 from sensors provided in reactor 3 and on combustion engine 5. The reaction temperature and the reaction pressure are received by control device 10 from reactor 3 as measurement signals on which the mixing ratio of alcohol, ether and water in the motor fuel mixture depends. Moreover, a knocking sensor 14 and a cylinder pressure sensor 15 send corresponding measurement signals to the control device 10 which together with further operating state signals, for example speed n, load and acceleration, characterize the current operating state of combustion engine 5. On the basis of these operating parameters of combustion engine 5, control device 10 can determine a suitable mixing ratio for the motor fuel mixture and effect an appropriate adjustment to the reaction in reactor 3.

Heating device 2 in the depicted exemplary embodiment consists of an exhaust-gas heat exchanger 16 and an air heat exchanger 17. An exhaust-gas line 18 leads from combustion engine 5 through the exhaust-gas heat exchanger 16 and, inside the exhaust-gas heat exchanger 16, heats the alcohol likewise directed through the exhaust-gas heat exchanger 16. The heated alcohol passes from the exhaust-gas heat exchanger 16 to the air heat exchanger 17, where ambient air flowing therethrough can be used to cool the alcohol down to a desired temperature. Both the exhaust-gas heat exchanger 16 and the air heat exchanger 17 can be controlled heat exchangers, facilitating controlled heat transfer. For instance, a bypass control in exhaust-gas heat exchanger 16 can be used to ensure that only a certain proportion of the exhaust-gas stream is used to heat the alcohol flowing therethrough. In the case of air heat exchanger 17, controlled cooling of the alcohol flowing therethrough is possible by control device 10 controlling, for example, the air throughput through the air heat exchanger 17.

It will be appreciated that a different heat transfer medium, such as water or oil (not depicted here), can also be used for heat exchanger 17 in place of air.

The pressure in the reactor can be varied using control elements as well as the temperature. One way to do this is by changing the methanol quantity pumped by pump P1, for example by changing the speed or lift or by means of a variable throttle disposed on the suction side of pump P1. A further way is to use a pressure control valve on the pressure side of pump P1 to adjust the pressure in the reactor irrespective of the reactor temperature.

The motor fuel mixture produced in reactor 3 can, if necessary, be aftertreated or intermediately stored in a chamber 4 downstream of reactor 3.

The invention claimed is:

1. A method for converting an alcohol into a fuel mixture which consists of alcohol, ether and water and is suitable for operating a combustion engine, comprising: converting, by a reaction using a catalyst, the alcohol into the fuel mixture in a reactor at a reaction temperature; and adjusting the mixing ratio of alcohol fraction, ether fraction and water fraction in the fuel mixture by controlling, by a control device, at least one reaction parameter of the reaction taking place in the reactor, wherein the at least one reaction parameter is controlled by the control device taking into account a first measurement signal indicating an operating parameter of an exhaust-gas aftertreatment system and a second measurement signal indicating an operating parameter of the combustion engine including at least one of speed, load, acceleration, cylinder pressure, and knocking.

2. The method according to claim 1, wherein the mixing ratio is adjusted by controlling at least one of the reaction temperature and the reaction pressure in the reactor.

3. The method according to claim 1, wherein the at least one reaction parameter is controlled by the control device taking into account the constitution of the alcohol to be converted.

4. The method according to claim 1, wherein the alcohol to be converted is a methanol-ethanol mixture.

5. The method according to claim 1, wherein the fuel mixture obtained according to said step of converting contains at least one of dimethyl ether and diethyl ether as ether fraction.

6. The method according to claim 1, further comprising the step of operating the combustion engine in the operating region of homogeneous compression ignition during said steps of converting and adjusting.

7. The method according to claim 1, the alcohol is converted into a fuel mixture such that the cetane number of the fuel mixture is above 50 during said step of converting.

8. The method according to claim 1, wherein the combustion engine is an internal combustion engine in a motor vehicle.

9. The method according to claim 1, wherein the second measurement signal indicates the speed of the combustion engine.

10. The method according to claim 1, wherein the second measurement signal indicates the cylinder pressure of the combustion engine.

11. The method according to claim 1, wherein the second measurement signal indicates knocking of the combustion engine.

12. The method according to claim 1, wherein the second measurement signal indicates the load of the combustion engine.

13. The method according to claim 1, wherein the second measurement signal indicates the acceleration of the combustion engine.

* * * * *